US011263938B1

(12) United States Patent
Dong et al.

(10) Patent No.: US 11,263,938 B1
(45) Date of Patent: Mar. 1, 2022

(54) LIGHT-EMITTING PANEL AND DISPLAY DEVICE

(71) Applicant: Shanghai Tianma Micro-Electronics Co., Ltd., Shanghai (CN)

(72) Inventors: Qiang Dong, Shanghai (CN); Lihua Wang, Shanghai (CN); Xiaoping Sun, Shanghai (CN); Conghua Ma, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 17/103,273

(22) Filed: Nov. 24, 2020

(30) Foreign Application Priority Data

Sep. 3, 2020 (CN) ..... 202010916185.6

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2310/0275* (2013.01)

(58) Field of Classification Search
CPC ..... G09G 3/30–3291; G09G 3/006
See application file for complete search history.

(56) References Cited

U.S. PATENT DOCUMENTS

2004/0246202 A1* 12/2004 Yamashita ..... H05B 45/60 345/30
2006/0164369 A1 7/2006 Park
2014/0313235 A1* 10/2014 Park ..... G09G 3/3291 345/690
2018/0293929 A1* 10/2018 Shigeta ..... G09G 3/2011

FOREIGN PATENT DOCUMENTS

| | | | |
|---|---|---|---|
| CN | 101512901 | A | 8/2009 |
| CN | 103150994 | A | 6/2013 |
| CN | 105118468 | A | 12/2015 |
| CN | 106469539 | A | 3/2017 |
| CN | 108258900 | A | 7/2018 |
| CN | 110085164 | A | 8/2019 |
| CN | 110322829 | A | 10/2019 |

* cited by examiner

*Primary Examiner* — Hang Lin
(74) *Attorney, Agent, or Firm* — Anova Law Group, PLLC

(57) ABSTRACT

A light-emitting panel and a display device are provided. The light-emitting panel includes a plurality of light-emitting components arranged in an array, a plurality of signal calculation modules, and a reference-signal generation module. A light-emitting component includes a light-emitting module and a first switch module. The light-emitting module and the first switch module are connected in series between a first power terminal and a second power terminal. A control terminal of the first switch module is connected to a signal calculation module, and the signal calculation module is connected to the reference-signal generation module. The reference-signal generation module is configured to generate a reference signal. The signal calculation module is configured to receive an original data signal and the reference signal, and generate a first data signal. The signal calculation module is further configured to generate a pulse width modulation signal, and to control the light-emitting module to emit light.

20 Claims, 11 Drawing Sheets

LIGHT-EMITTING PANEL AND DISPLAY DEVICE

CROSS-REFERENCE TO RELATED APPLICATION

This application claims priority of Chinese Patent Application No. 202010916185.6, filed on Sep. 3, 2020, the entire content of which is hereby incorporated by reference.

FIELD OF THE DISCLOSURE

The present disclosure generally relates to the field of display technology and, more particularly, relates to a light-emitting panel and a display device.

BACKGROUND

With development of display technology, various types of light-emitting devices may be used in display devices to realize display functions of the display devices.

At current stage, a gray scale of a light-emitting device may be controlled by controlling current with voltage. A driving voltage signal may be used to control a driving transistor that controls light emission of a light-emitting device. A driving voltage signal with higher voltage may result in greater driving current corresponding to the driving transistor. The driving current may realize gray-scale control of the light-emitting device. However, due to operating characteristics of a driving transistor, after voltage of a driving voltage signal exceeds a certain threshold, change of driving current of the driving transistor may not be controlled. Correspondingly, precise control of a gray scale of the light-emitting device may not be achieved.

The disclosed structures and methods are directed to solve one or more problems set forth above and other problems in the art.

SUMMARY

One aspect of the present disclosure includes a light-emitting panel. The light-emitting panel includes a plurality of light-emitting components arranged in an array, a plurality of signal calculation modules, a reference-signal generation module, a first power terminal, and a second power terminal. A light-emitting component of the plurality of light-emitting components includes a light-emitting module and a first switch module. The light-emitting module and the first switch module are connected in series between the first power terminal and the second power terminal. A control terminal of the first switch module is connected to a signal calculation module of the plurality of signal calculation modules, and the signal calculation module is connected to the reference-signal generation module. The reference-signal generation module is configured to generate a reference signal. The signal calculation module is configured to receive an original data signal and the reference signal, and generate a first data signal according to the original data signal and a common potential. The signal calculation module is further configured to generate a pulse width modulation signal according to the first data signal and the reference signal, and to control the light-emitting module to emit light by controlling the first switch module using the pulse width modulation signal. The original data signal is an analog signal for characterizing image information of a display area corresponding to the light-emitting component. The common potential is preset according to a voltage range of the original data signal.

Another aspect of the present disclosure includes a display device. The display device includes a light-emitting panel. The light-emitting panel includes a plurality of light-emitting components arranged in an array, a plurality of signal calculation modules, a reference-signal generation module, a first power terminal, and a second power terminal. A light-emitting component of the plurality of light-emitting components includes a light-emitting module and a first switch module. The light-emitting module and the first switch module are connected in series between the first power terminal and the second power terminal. A control terminal of the first switch module is connected to a signal calculation module of the plurality of signal calculation modules, and the signal calculation module is connected to the reference-signal generation module. The reference-signal generation module is configured to generate a reference signal. The signal calculation module is configured to receive an original data signal and the reference signal, and generate a first data signal according to the original data signal and a common potential. The signal calculation module is further configured to generate a pulse width modulation signal according to the first data signal and the reference signal, and to control the light-emitting module to emit light by controlling the first switch module using the pulse width modulation signal. The original data signal is an analog signal for characterizing image information of a display area corresponding to the light-emitting component. The common potential is preset according to a voltage range of the original data signal.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
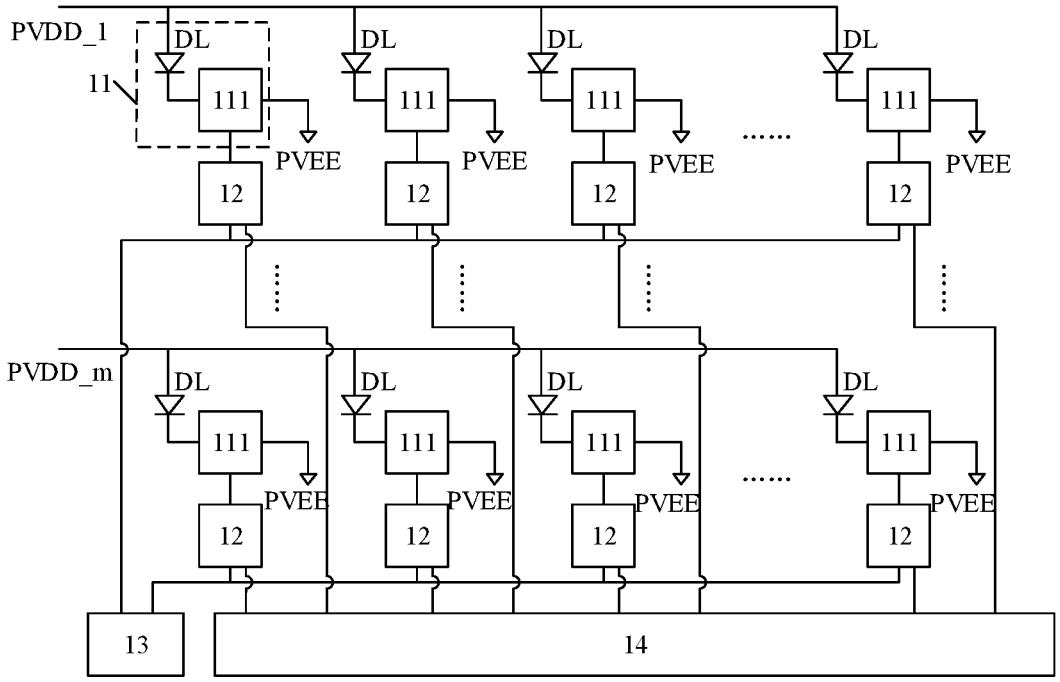
FIG. 1 illustrates a structural diagram of a light-emitting panel consistent with the disclosed embodiments of the present disclosure.

To make the objectives, technical solutions and advantages of the present disclosure clearer and more explicit, the present disclosure is described in further detail with accompanying drawings and embodiments. It should be understood that the specific exemplary embodiments described herein are only for explaining the present disclosure and are not intended to limit the present disclosure.

Reference will now be made in detail to exemplary embodiments of the present disclosure, which are illustrated in the accompanying drawings. Wherever possible, the same reference numbers will be used throughout the drawings to refer to the same or like parts.

It should be noted that relative arrangements of components and steps, numerical expressions and numerical values set forth in exemplary embodiments are for illustration purpose only and are not intended to limit the present disclosure unless otherwise specified. Techniques, methods and apparatus known to the skilled in the relevant art may not be discussed in detail, but these techniques, methods and apparatus should be considered as a part of the specification, where appropriate.

It should be noted that in the present disclosure, relational terms such as "first" and "second" are used only to distinguish one entity or operation from another entity or operation, and do not necessarily require or imply any such actual relationship or order between these entities or operations.

It should be noted that in the present disclosure, a function or a partial function of an embodiment may be realized by a single hardware or software module.

With development of display technology, a light-emitting device may be used in a display device to realize a display function of the display device. A light-emitting device may be used as a component of a backlight module, or a component of a display panel. The present disclosure does not limit whether a light-emitting device is used as a component of a backlight module, or a component of a display panel. A light-emitting device needs to be driven to emit light, such that an image display function of a display device may be realized. A display device may have a plurality of display areas. Each display area of the plurality of display areas may display an image according to an original data signal of the display area, such that image display of an entire display device may be realized.

The present disclosure provides a light-emitting panel and a display device. The light-emitting panel and the display device may generate a pulse width modulation (PWM) signal according to an original data signal and a reference signal. The original data signal may be used to characterize image information of a display area corresponding to a light-emitting component in the display device. The light-emitting panel and the display device may use the pulse width modulation signal to drive the light-emitting component. The pulse width modulation signal may be used as a driving signal for driving the light-emitting component. A light-emission duration of the light-emitting component may be controlled by the pulse width modulation signal, such that a precise control of a gray scale of the light-emitting component may be realized.

Figure 2:
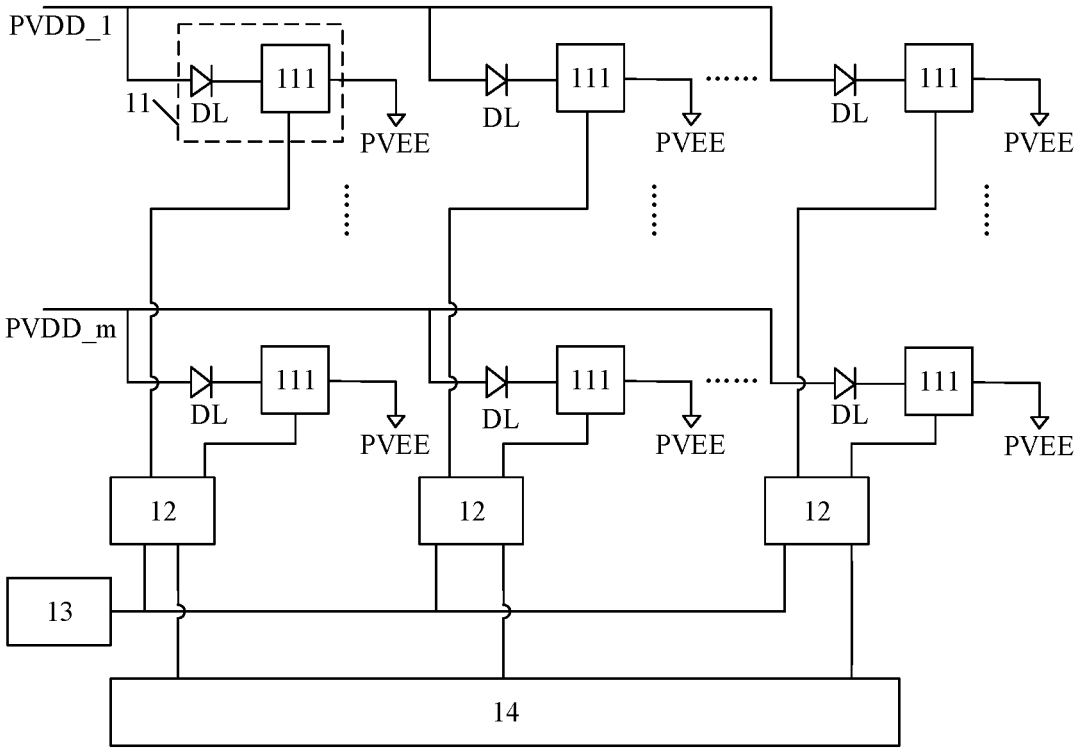
FIG. 2 illustrates a structural diagram of another light-emitting panel consistent with the disclosed embodiments of the present disclosure.

FIG. 1 illustrates a structural diagram of a light-emitting panel consistent with the disclosed embodiments of the present disclosure. FIG. 2 illustrates a structural diagram of another light-emitting panel consistent with the disclosed embodiments of the present disclosure. As shown in FIG. 1 and FIG. 2, a light-emitting panel may include a plurality of light-emitting components 11 arranged in an array, a plurality of signal calculation modules 12 and a reference-signal generation module 13. Each light-emitting component 11 of the plurality of light-emitting components includes a light-emitting module and a first switch module 111 that are connected in series between a first power terminal PVDD and a second power terminal PVEE. The light-emitting module may include one or more light-emitting diodes DL. The present disclosure does not limit the number of light-emitting diodes in the light-emitting module. In some embodiments, the light-emitting diode DL may include a micro light-emitting diode DL (i.e., Micro/Mini LED). A control terminal of the first switch module 111 is connected to a signal calculation module 12 of the plurality of signal calculation modules. The signal calculation module 12 is connected to the reference-signal generation module 13.

In one embodiment, one terminal of the light-emitting module is connected to the first power supply terminal PVDD, and another terminal of the light-emitting module is connected to a first terminal of the first switch module 111. A control terminal of the first switch module 111 is connected to the signal calculation module 12, and a second terminal of the first switch module 111 is connected to the second power terminal PVEE.

In one embodiment, as shown in FIG. 1, the light-emitting module includes one light-emitting diode DL. An anode of the light-emitting diode DL is connected to the first power terminal PVDD, and a cathode of the light-emitting diode DL is connected to the first terminal of the first switch module 111.

The first power supply terminal PVDD and the second power supply terminal PVEE may provide a working voltage for the light-emitting module. Voltage signals provided by the first power terminal PVDD and the second power terminal PVEE may be set according to working scenarios and working requirements, and are not limited in the present disclosure. The first power supply terminal PVDD and the second power supply terminal PVEE may be implemented as crisscrossed power wirings. A line width of the power wirings may be a maximum line width limited by a wiring space in the light-emitting panel. Accordingly, resistance of the power wirings may be reduced, and power consumption of the light-emitting panel may thus be reduced.

In some embodiments, the first power terminal PVDD may be a working power terminal. Voltage of the working power terminal may be set according to working scenarios and working requirements, and is not limited in the present disclosure. The second power terminal PVEE may be ground.

The reference-signal generation module 13 may be used to generate a reference signal. The signal calculation module 12 may be used to receive an original data signal (i.e. source signal) and the reference signal generated by the reference-signal generation module 13, and generate a first data signal according to the original data signal and a common potential. The signal calculation module 12 may further generate a pulse width modulation signal according to the first data signal and the reference signal. The light-emitting module may be controlled to emit light by controlling the first switch module with the pulse width modulation signal.

The original data signal is an analog signal for characterizing image information of a display area corresponding to the light-emitting component 11. Specifically, the original data signal may be an analog signal provided by an external input of the display device or by a source integrated circuit (Source IC) 14 of the display device. The Source IC 14 may convert a digital display signal into an analog display signal. The analog display signal is the original data signal.

Based on the common potential, the first data signal may be obtained according to the original data signal. In some embodiments, voltage of the first data signal may be higher than or equal to the common potential. The common potential may be preset. Specifically, a value of the common potential may be determined according to a voltage range of the original data signal, and is not limited in the present disclosure. Voltage of the original data signal may range up and down around the common potential. For example, when the voltage of the original data signal ranges from −12 volts to 12 volts, the common potential may be correspondingly zero (0) volts.

The reference signal may be a periodic signal. Specifically, the pulse width modulation signal may be generated by comparing the first data signal with the reference signal. In some embodiments, when the first data signal has higher voltage, the pulse width modulation signal may have a greater duty ratio, and the light-emitting module that emits light may have a greater brightness. The reference signal may include a triangular wave or a sawtooth wave. The present disclosure does not limit wave shapes of the reference signal.

Wirings arranged in the light-emitting panel for transmitting the pulse width modulation signals from the signal calculation modules 12 to the first switch modules 111 do not cross. Accordingly, mutual interference between the pulse width modulation signals may be avoided.

Figure 3:
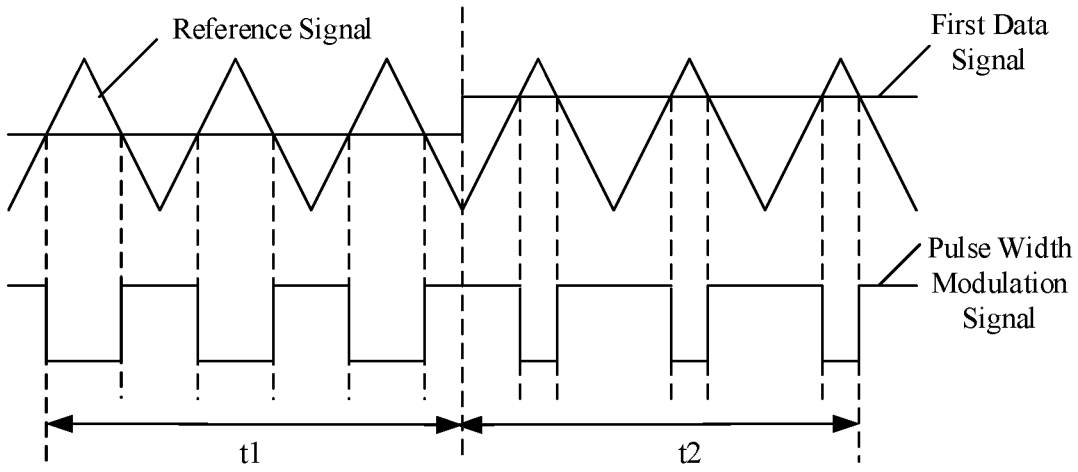
FIG. 3 illustrates a schematic diagram of a first data signal, a reference signal, and a pulse width modulation signal, consistent with the disclosed embodiments of the present disclosure.

FIG. 3 illustrates a schematic diagram of a first data signal, a reference signal, and a pulse width modulation signal consistent with the disclosed embodiments of the present disclosure. As shown in FIG. 3, the reference signal may be a triangle wave. When the voltage of the first data signal is lower than the voltage of the reference signal, a signal generated by the signal calculation module 12 may be at a low voltage level. When the voltage of the first data signal is higher than the voltage of the reference signal, the signal generated by the signal calculation module 12 may be at a high voltage level. With a voltage change of the reference signal (that is, a triangular wave), the signal calculation module 12 may output a signal with alternating high and low voltage levels, and the pulse width modulation signal is thus formed. The voltage of the first data signal in a period t1 may be different from the voltage of the first data signal in a period t2. In one embodiment, the voltage of the first data signal in the period t2 is greater than the voltage of the first data signal in the period t1. Correspondingly, a duty ratio of the pulse width modulation signal generated in the period t2 may be greater than a duty ratio of the pulse width modulation signal generated in the period t1. When the pulse width modulation signal has a greater duty ratio, the light-emitting module may have a greater brightness.

Figure 4:
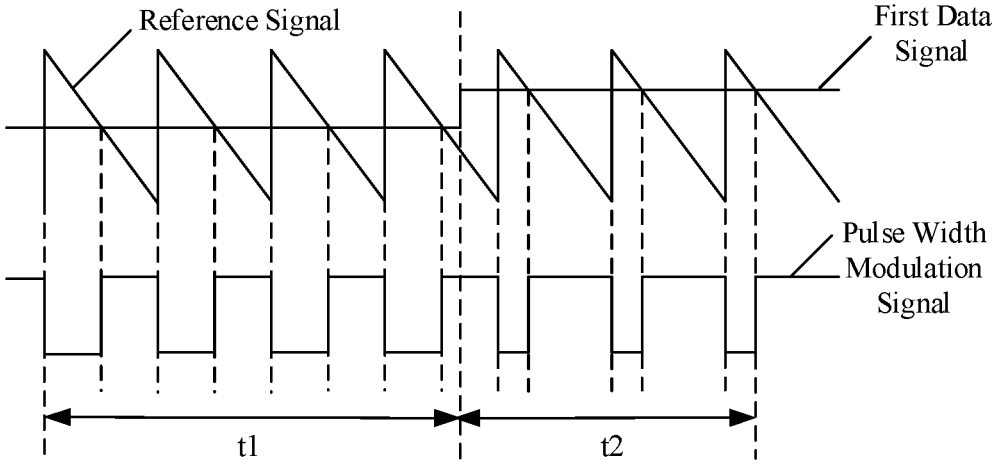
FIG. 4 illustrates another schematic diagram of a first data signal, a reference signal, and a pulse width modulation signal, consistent with the disclosed embodiments of the present disclosure.

FIG. 4 illustrates another schematic diagram of a first data signal, a reference signal, and a pulse width modulation signal consistent with the disclosed embodiments of the present disclosure. As shown in FIG. 4, the reference signal may be a sawtooth wave. When the voltage of the first data signal is lower than the voltage of the reference signal, a signal generated by the signal calculation module 12 may be at a low voltage level. When the voltage of the first data signal is higher than the voltage of the reference signal, the signal generated by the signal calculation module 12 may be at a high voltage level. With a voltage change of the reference signal (that is, a sawtooth wave), the signal calculation module 12 may output a signal with alternating high and low voltage levels, and the pulse width modulation signal is thus formed. The voltage of the first data signal in a period t1 may be different from the voltage of the first data signal in a period t2. In one embodiment, the voltage of the first data signal in the period t2 is greater than the voltage of the first data signal in the period t1. Correspondingly, a duty ratio of the pulse width modulation signal generated in the period t2 is greater than a duty ratio of the pulse width modulation signal generated in the period t1. When the pulse width modulation signal has a greater duty ratio, the light-emitting module may have a greater brightness.

In one embodiment, the signal calculation module 12 may generate the first data signal according to the original data signal and the common potential, and then generate the pulse width modulation signal according to the first data signal and the reference signal generated by the reference-signal generation module 13. The original data signal is an analog signal used to characterize image information of a display area corresponding to the light-emitting component 11. That is, the first data signal may be obtained by processing the analog signal (i.e., the original data signal) representing the image information, and may be converted to obtain the pulse width modulation signal for controlling light emission of the light-emitting component 11. The pulse width modulation signal includes a high level and a low level, and the light-emission duration of the light-emitting component may be controlled by the duty ratio of the pulse width modulation signal. That is, the pulse width modulation signal may be used to control the light-emission duration of the light-emitting component. Accordingly, the gray scale of the light-emitting component may be controlled by the light-emission duration, instead of the voltage. As such, precise control of the gray level may be realized.

When the light-emitting panel is a backlight module, the pulse width modulation signal may be obtained by converting the first data signal obtained by processing the analog signal (i.e., the original data signal) representing the image information. The pulse width modulation signal may be used to control the light-emitting component 11 to emit light. The backlight module does not need an additional driving integrated circuit for driving the light-emitting component of the backlight module. The backlight module may share the Source IC 14 with the display panel. By using a light-emitting panel provided by the present disclosure, a structure of the display device may be simplified, and a cost of the display device may also be reduced.

In some embodiments, as shown in FIG. 1, the light-emitting module may include a light-emitting diode DL. That is, the light-emitting component 11 may include the light-emitting diode DL and a first switch module 111. The light-emitting components 11 and the signal calculation modules 12 may be arranged in one-to-one correspondence. That is, each light-emitting component 11 may be correspondingly provided with a signal calculation module 12. Specifically, in each light-emitting component 11, a control terminal of the first switch module 111 is connected to the signal calculation module 12 correspondingly, and a first terminal of the first switch module 111 is connected to a cathode of the light-emitting diode DL. A second terminal of the first switch module 111 is connected to the second power terminal PVEE. An anode of the light-emitting diode DL is connected to the first power supply terminal PVDD.

In the present disclosure, a light-emitting panel may include more than one first power supply terminals PVDD, and the light-emitting components 11 arranged in a row may be connected to one of the first power supply terminals PVDD. In one embodiment, as shown in FIG. 1, the first row of light-emitting components 11 is connected to the first of the first power terminals PVDD_1, and the m-th row of light-emitting components 11 is connected to the m-th of the first power terminals PVDD_m. The m power supply terminals PVDD, including the first of the first power supply terminals PVDD_1 to the m-th of the first power supply terminals PVDD_m, may be connected together.

The pulse width modulation signal generated by the signal calculation module 12 and the signal provided by the first power supply terminals PVDD may jointly control the light-emitting component 11 to emit light. Accordingly, precise control of the gray scale of the light-emitting component 11 may be achieved. Moreover, the signal calculation module 12 corresponding to each light-emitting component 11 may generate the pulse width modulation signal for driving the light-emitting component 11, such that the light-emitting component 11 may be driven at a faster response speed.

In some other embodiments, as shown in FIG. 2, each column of light-emitting components 11 may be correspondingly provided with one signal calculation module 12. Each light-emitting element 11 in each column of light-emitting elements 11 may be connected to a different first power supply terminal PVDD. Specifically, the control terminal of the first switch module 111 in each column of the light-emitting components 11 may be correspondingly connected to one signal calculation module 12. In each light-emitting component 11, the first terminal of the first switch module 111 may be connected to the cathode of the light-emitting diode DL. The second terminal of the first switch module 111 may be connected to the second power terminal PVEE. The anode of the light-emitting diode DL may be connected to the first power supply terminal PVDD.

The number of the first power supply terminals PVDD may be more than one, and a row of the light-emitting components 11 may be connected to one of the first power supply terminals PVDD. In one embodiment, as shown in FIG. 2, the first row of light-emitting components 11 is connected to the first of the first power terminal PVDD_1, and the m-th row of light-emitting components 11 is connected to the m-th of first power terminals PVDD_m. The first light-emitting component 11 in each row forms a first column of light-emitting components 11, the second light-emitting component 11 in each row forms a second column of light-emitting components 11, and so on.

The pulse width modulation signal generated by the signal calculation module 12 and the signal provided by the first power supply terminal PVDD may jointly control the light-emitting component 11 to emit light. Accordingly, precise control of the gray scale of the light-emitting component 11 may be achieved. Moreover, a column of light-emitting components 11 may share one of the signal calculation modules 12. Accordingly, the number of the signal calculation modules 12 may be reduced, and the structure of the light-emitting panel may be simplified.

As shown in FIG. 1 and FIG. 2, the plurality of light-emitting components 11 arranged in an array may share one reference-signal generation module 13. That is, the plurality of signal calculation modules 12 may be connected to a same reference-signal generation module 13. Since the reference signal required by each signal calculation module 12 may be same, only one reference-signal generation module 13 may be required to meet the requirements of the light-emitting panel, and thus the structure of the light-emitting panel may be simplified. The original data signals received by the plurality of signal calculation modules 12 may be the original data signals input from an outside world, or signals output by the Source IC. The original data signals received by different signal calculation modules 12 may be same or different. The original data signals may be specifically determined according to images displayed by the display device, and are not limited in the present disclosure.

Figure 5:
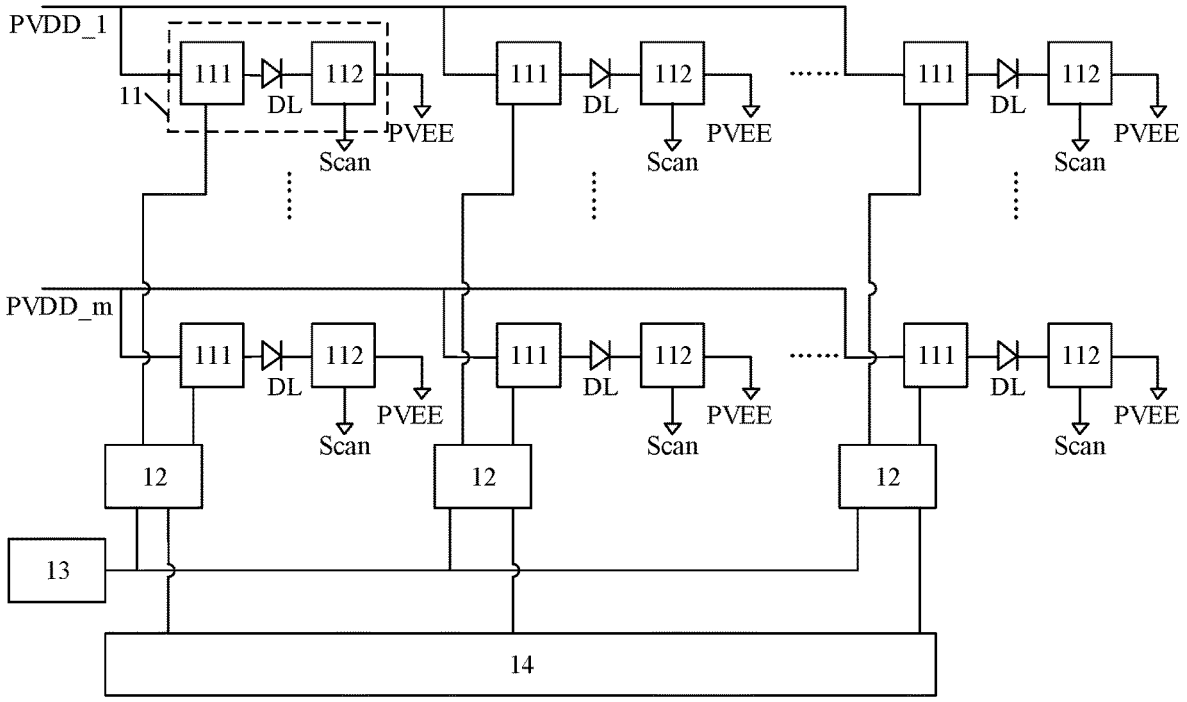
FIG. 5 illustrates a structural diagram of another light-emitting panel consistent with the disclosed embodiments of the present disclosure.

In some embodiments, the light-emitting component 11 may further include a second switch module 112. The second switch module 112 may be located between the light-emitting module and the second power terminal PVEE. FIG. 5 illustrates a structural diagram of another light-emitting panel consistent with the disclosed embodiments of the present disclosure. As shown in FIG. 5, the light-emitting module includes a light-emitting diode DL. The light-emitting component 11 also includes a second switch module 112. A control terminal of the second switch module 112 is connected to a scan signal terminal Scan. A first terminal of the second switch module 112 is connected to the cathode of the light-emitting diode DL, and a second terminal of the second switch module 112 is connected to the second power terminal PVEE. The anode of the light-emitting diode DL is connected to the second terminal of the first switch module 111. The control terminal of the first switch module 111 is connected to the signal calculation module 12, and the first terminal of the first switch module 111 is connected to the first power terminal PVDD.

The pulse width modulation signal output by the signal calculation module 12 may control the first switch module 111 to be turned on or off, such that the signal transmitted to the light-emitting diode DL is a pulse width modulation signal formed from the voltage signal of the first power terminal PVDD. A scan signal output from the scan signal terminal Scan may control the second switch module 112 to be turned on or off. In conjunction with the scan signal output by the scan signal terminal Scan, the pulse width modulation signal may drive the light-emitting diodes DL in the plurality of light-emitting components 11 to emit light. In some embodiments, the scan signal terminal Scan may belong to a data signal integrated circuit (that is, belong to the Source IC 14) in the display device. It may be understood that the scan signal may be provided by the data signal integrated circuit (that is, the source IC 14) in the display device. The scan signal terminals corresponding to the second switch modules 112 in a same row of light-emitting components 11 may be connected.

The connection relationship between the signal calculation module 12 and the light-emitting component 11 including the second switch module 112 in FIG. 5 is basically same as the connection relationship between the signal calculation module 12 and the light-emitting component 11 shown in FIG. 2. In the light-emitting panel shown in FIG. 5, the scan signal terminals corresponding to the second switch module 112 in each row of light-emitting components 11 may be connected.

It should be noted that, about the connection relationship between the signal calculation module 12 and the light-emitting component 11 including the second switch module 112, reference may be made to the connection relationship between the signal calculation module 12 and the light-emitting component 11 shown in FIG. 1.

Figure 6:
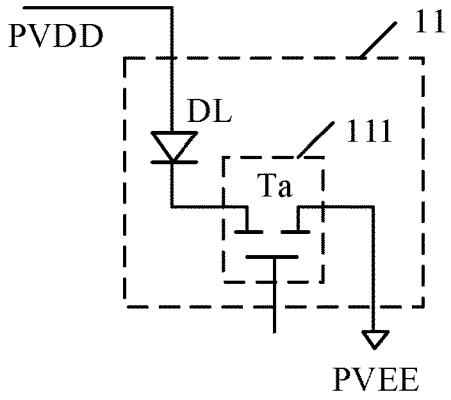
FIG. 6 illustrates a structural diagram of an exemplary switch assembly consistent with the disclosed embodiments of the present disclosure.

In one embodiment, the first switch module 111 may include a switch transistor. The control terminal of the first switch module 111 may include a control terminal of the switch transistor. A first terminal or a second terminal of the switch transistor may be connected to the light-emitting module. FIG. 6 illustrates a structural diagram of an exemplary switch assembly consistent with the disclosed embodiments of the present disclosure. As shown in FIG. 6, the first switch module 111 includes a switch transistor Ta. The control terminal of the switch transistor Ta is connected to the signal calculation module 12, the first terminal of the switch transistor Ta is connected to the cathode of the light-emitting diode DL, and the second terminal of the switch transistor Ta is connected to the second power terminal PVEE. The anode of the light-emitting diode DL is connected to the first power supply terminal PVDD.

Figure 7:
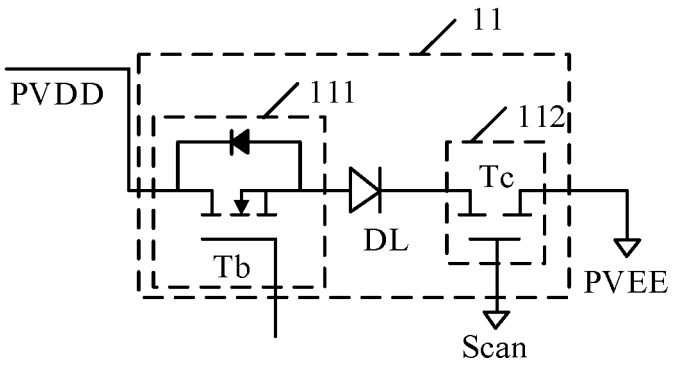
FIG. 7 illustrates a structural diagram of another exemplary switch assembly consistent with the disclosed embodiments of the present disclosure.

In one embodiment, the second switch module 112 may also include a switch transistor. The control terminal of the second switch module 112 may include a control terminal of the switch transistor. A first terminal or a second terminal of the second switch module 112 is connected to the light-emitting module. FIG. 7 illustrates a structural diagram of another exemplary switch assembly consistent with the disclosed embodiments of the present disclosure. As shown in FIG. 7, the first switch module 111 includes a switch transistor Tb, and the second switch module 112 includes a switch transistor Tc. A control terminal of the switch transistor Tb is connected to the signal calculation module 12, a first terminal of the switch transistor Tb is connected to the first power supply terminal PVDD, and a second terminal of the switch transistor Tb is connected to the anode of the light-emitting diode DL. A control terminal of the switch diode Tc is connected to the scan signal terminal Scan, a first terminal of the switch diode Tc is connected to the cathode of the light-emitting diode DL, and a second terminal of the switch diode Tc is connected to the second power terminal PVEE.

Specifically, the switch transistor may be a field effect transistor (FET), such as a thin film transistor (TFT), a junction field-effect transistor (JFET), a metal-oxide-semiconductor field-effect transistor (MOSFET), etc. The present disclosure does not limit types of the switch transistor. For convenience of description, the present disclosure takes the switch transistor as an N-type transistor as an example.

Specific components of the signal calculation module 12 and the reference-signal generation module 13 are described below.

Figure 8:
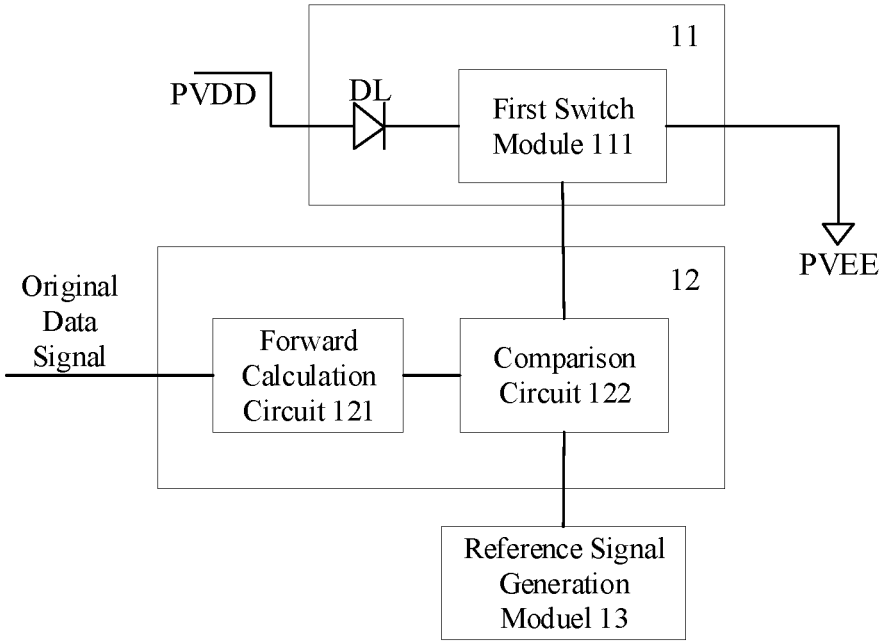
FIG. 8 illustrates a structural diagram of a partial circuit of an exemplary light-emitting panel consistent with the disclosed embodiments of the present disclosure.

FIG. 8 illustrates a structural diagram of a partial circuit of an exemplary light-emitting panel consistent with the disclosed embodiments of the present disclosure. In one embodiment, as shown in FIG. 8, the signal calculation module 12 may include a forward calculation circuit 121 and a comparison circuit 122. The forward calculation circuit 121 is configured to receive the original data signal. The comparison circuit 122 is connected to the forward calculation circuit 121, the reference-signal generation module 13, and the first switch module 111.

Figure 9:
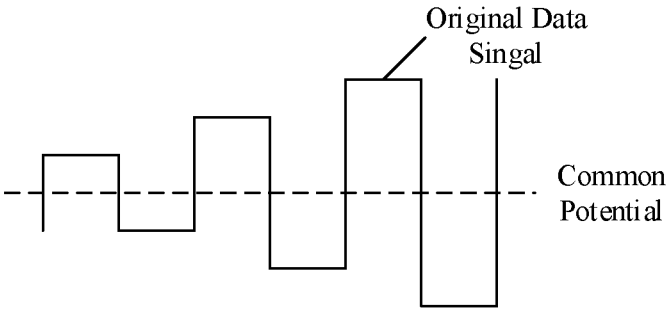
FIG. 9 illustrates a schematic diagram of an original data signal and a common potential of an exemplary light-emitting panel consistent with the disclosed embodiments of the present disclosure.
Figure 10:
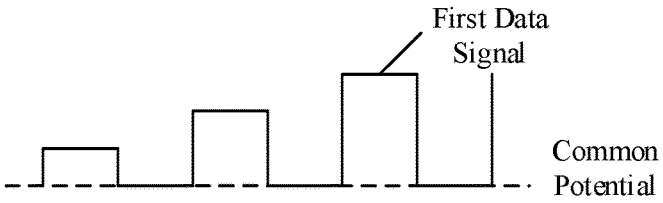
FIG. 10 illustrates a schematic diagram of a first data signal generated according to the original data signal and the common potential in the exemplary light-emitting panel according to FIG. 9, consistent with the disclosed embodiments of the present disclosure.

The forward calculation circuit 121 may be used to adjust signal voltage lower than the common potential in the original data signal to the common potential, and then generate and output the first data signal. FIG. 9 illustrates a schematic diagram of an original data signal and a common potential of an exemplary light-emitting panel consistent with the disclosed embodiments of the present disclosure. FIG. 10 illustrates a schematic diagram of a first data signal generated according to the original data signal and the common potential in the exemplary light-emitting panel according to FIG. 9, consistent with the disclosed embodiments of the present disclosure. As shown in FIG. 9 and FIG. 10, comparing the first data signal with the original data signal, voltages at portions in the first data signal corresponding to portions in the original data signal with voltages lower than the common potential are adjusted to the common potential.

The comparison circuit 122 may be used to compare the first data signal and the reference signal, and generate the pulse width modulation signal. For specific contents of the first data signal, the reference signal and the pulse width modulation signal, reference may be made to relevant parts in above descriptions.

Specific structures of the forward calculation circuit 121 and the comparison circuit 122 in the signal calculation module 12 are described below.

Figure 11:
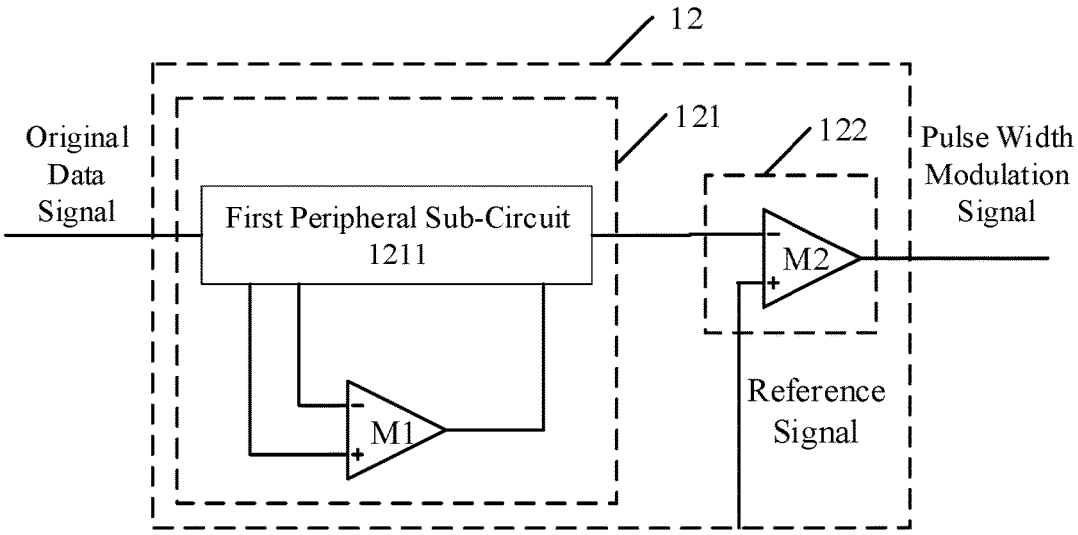
FIG. 11 illustrates a structural diagram of an exemplary forward calculation circuit consistent with the disclosed embodiments of the present disclosure.

FIG. 11 illustrates a structural diagram of an exemplary forward calculation circuit consistent with the disclosed embodiments of the present disclosure. In one embodiment, as shown in FIG. 11, the forward calculation circuit 121 may include a first operational amplifier M1 and a first peripheral sub-circuit 1211.

A first non-inverting input terminal of the first operational amplifier M1, a first inverting input terminal of the first operational amplifier M1, and a first output terminal of the first operational amplifier M1 are connected to the first peripheral sub-circuit 1211. The first peripheral sub-circuit 1211 is configured to receive the original data signal. The first non-inverting input terminal is the non-inverting input terminal of the first operational amplifier M1. The first inverting input terminal is the inverting input terminal of the first operational amplifier M1. The first output terminal is the output of the first operational amplifier M1 terminal.

In one embodiment, the comparison circuit 122 may include a second operational amplifier M2. A second non-inverting input terminal of the second operational amplifier M2 is connected to the reference-signal generation module 13. A second inverting input terminal of the second operational amplifier M2 is connected to the first output terminal of the first operational amplifier M1 and the first peripheral sub-circuit 1211. A second output terminal of the second operational amplifier M2 is connected to the control terminal of the first switch module 111. The second non-inverting input terminal receives the reference signal, and the second inverting input terminal receives the first data signal output by the forward calculation circuit 121. The second non-inverting input terminal is a non-inverting input terminal of the second operational amplifier M2. The second inverting input terminal is an inverting input terminal of the second operational amplifier M2. The second output terminal is an output terminal of the second operational amplifier M2.

Figure 12:
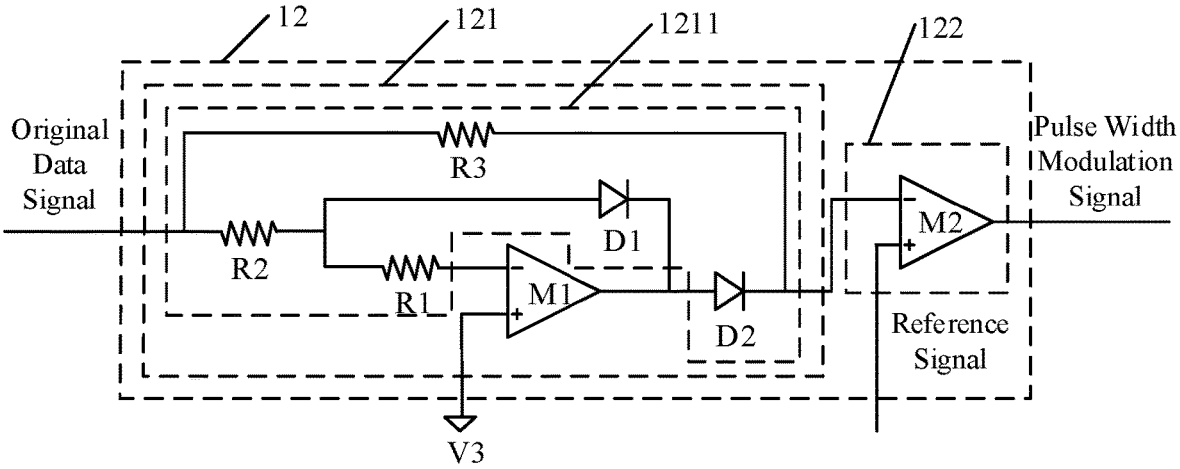
FIG. 12 illustrates a specific structural diagram of an exemplary signal calculation module consistent with the disclosed embodiments of the present disclosure.

The first operational amplifier M1 and the first peripheral sub-circuit 1211 may work together to realize a function of the forward calculation circuit 121. By taking specific structures of exemplary first peripheral sub-circuits 1211 as examples, specific structures of the signal calculation module 12 are described below FIG. 12 illustrates a specific structural diagram of an exemplary signal calculation module consistent with the disclosed embodiments of the present disclosure. The structure of the comparison circuit 122 in FIG. 12 is consistent with above descriptions. In one embodiment, the common potential is taken as zero (0). As shown in FIG. 12, the first operational amplifier is labelled with M1, and the second operational amplifier is labelled with M2. A working voltage terminal of the first operational amplifier M1 and a working voltage terminal of the second operational amplifier M2 are omitted in FIG. 12. The first peripheral sub-circuit 1211 may include a first resistor R1, a second resistor R2, a third resistor R3, a first diode D1, and a second diode D2.

The second resistor R2 is configured to receive the original data signal. The second resistor R2 is connected in series with the first resistor R1, and the first resistor R1 is connected to the first inverting input terminal. The second resistor R2, the first diode D1, and the second diode D2 are connected in series. The third resistor R3 is connected in parallel with the second resistor R2, the first diode D1 and the second diode D2 connected in series. The cathode of the first diode D1 and the anode of the second diode D2 are connected to the first output terminal. The first non-inverting input terminal is connected to the third power terminal V3. The anode of the second diode D2 is connected to the second inverting input terminal. The third power terminal V3 may be set according to working scenarios and working requirements, and is not limited in the present disclosure. For example, the third power terminal V3 may be ground.

In one embodiment, the first peripheral sub-circuit 1211 may work together with the first operational amplifier M1. By using unidirectional conductivity of the first diode D1 and the second diode D2, portions of the original data signal with voltages lower than zero (0) may be filtered out. In the first data signal, voltages corresponding to portions of the original data signal with voltages lower than zero (0) are set to be zero (0). Accordingly, the first output terminal may output the first data signal shown in FIG. 10.

Figure 13:
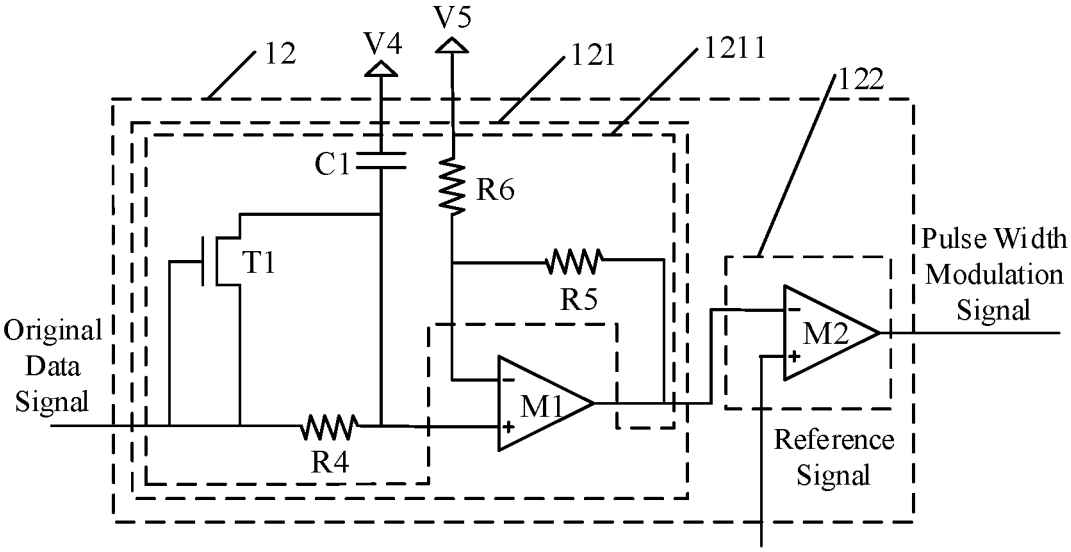
FIG. 13 illustrates a specific structural diagram of another exemplary signal calculation module consistent with the disclosed embodiments of the present disclosure.

FIG. 13 illustrates a specific structural diagram of another exemplary signal calculation module consistent with the disclosed embodiments of the present disclosure. A structure of the comparison circuit 122 is consistent with above descriptions. In one embodiment, the common potential is taken as zero (0). As shown in FIG. 13, the first operational amplifier is labelled with M1, and the second operational amplifier is labelled with M2. The working voltage terminal of the first operational amplifier M1 and the working voltage terminal of the second operational amplifier M2 are omitted in FIG. 13. The first peripheral sub-circuit 1211 includes a fourth resistor R4, a fifth resistor R5, a sixth resistor R6, a first capacitor C1, and a first switch transistor T1.

A control terminal of the first switch transistor T1 and the fourth resistor R4 are configured to receive the original data signal. The first switch transistor T1 is connected in parallel with the fourth resistor R4. One terminal of the first capacitor C1 is connected to the first switch transistor T1 and the fourth resistor R4 that are connected in parallel. The other terminal of the first capacitor C1 is connected to a fourth power terminal V4. The first switch transistor T1 and the fourth resistor R4 that are connected in parallel are connected to the first non-inverting input terminal. The fifth resistor R5 is located between the first inverting input terminal and the first output terminal. The sixth resistor R6 is located between the first inverting input terminal and a fifth power terminal V5. The first output terminal is connected to the second inverting input terminal. The fourth power terminal V4 and the fifth power terminal V5 may be set according to working scenarios and working requirements, and are not limited in the present disclosure. For example, the fourth power terminal V4 and the fifth power terminal V5 may be ground.

When the voltage of the original data signal is higher than the common potential, the first switch transistor T1 is turned on. On one hand, the original data signal with voltage higher than the common potential may charge the first capacitor C1 through the first switch transistor T1, such that the first capacitor C1 may store electric energy. On the other hand, the original data signal with voltage higher than the common potential may be transmitted to the first non-inverting input terminal of the first operational amplifier M1. When the voltage of the original data signal is lower than the common potential, the first switch transistor T1 is turned off, and the first capacitor C1 may release the electric energy previously stored to neutralize the original data signal with voltage lower than the common potential. Accordingly, the voltage lower than the common potential in the original data signal may be adjusted to the common potential. That is, in the first data signal, the signal voltage corresponding to a portion of the original data signal with voltage lower than zero (0) is set to be zero (0). Accordingly, the first output terminal may output the first data signal shown in FIG. 10.

Figure 14:
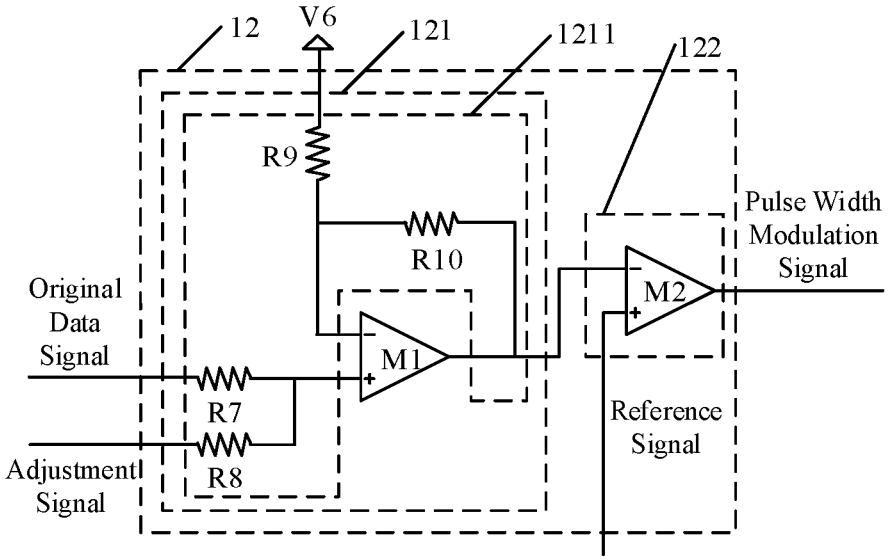
FIG. 14 illustrates a specific structural diagram of another exemplary signal calculation module consistent with the disclosed embodiments of the present disclosure.

FIG. 14 illustrates a specific structural diagram of another exemplary signal calculation module consistent with the disclosed embodiments of the present disclosure. The structure of the comparison circuit 122 is consistent with above descriptions. In one embodiment, the common potential is taken as zero (0). As shown in FIG. 14, the first operational amplifier is labelled with M1, and the second operational amplifier is labelled with M2. The working voltage terminal of the first operational amplifier M1 and the working voltage terminal of the second operational amplifier M2 are omitted in FIG. 14. The first peripheral sub-circuit 1211 includes a seventh resistor R7, an eighth resistor R8, a ninth resistor R9, and a tenth resistor R10.

The seventh resistor R7 is configured to receive the original data signal. The eighth resistor R8 is configured to receive an adjustment signal. The adjustment signal may be used to raise the signal voltage lower than the common potential in the original data signal to the common potential. The adjustment signal may be set according to working scenarios and working requirements, and is not limited in the present disclosure.

The seventh resistor R7 and the eighth resistor R8 are connected to the first non-inverting input terminal. The ninth resistor R9 is located between the sixth power terminal V6 and the first inverting input terminal. The tenth resistor R10 is located between the first inverting input terminal and the first output terminal. The first output terminal is connected to the second inverting input terminal. The sixth power terminal V6 may be set according to working scenarios and working requirements, and is not limited in the present disclosure. For example, the sixth power terminal V6 may be ground.

In one embodiment, the first peripheral sub-circuit 1211 and the first operational amplifier M1 may form a non-inverting adder. The adjustment signal may be used to increase the voltage of the portion of the original data signal with voltage lower than zero (0), such that, in the first data signal output, the voltage of the signal corresponding to the portion of the original data signal with voltage lower than zero (0) is set to be zero (0). That is, the first output terminal may output the first data signal shown in FIG. 10.

Figure 15:
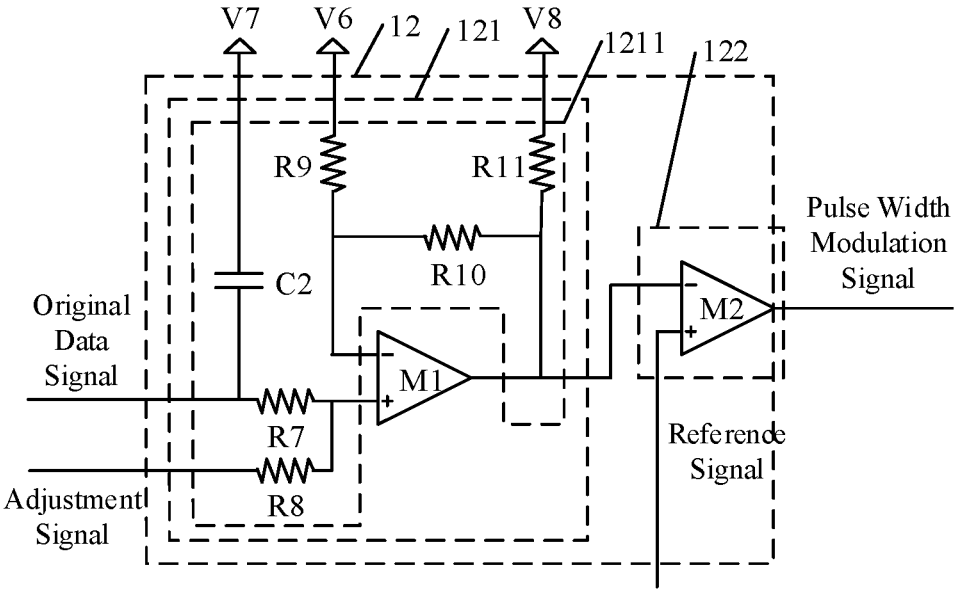
FIG. 15 illustrates a specific structural diagram of another exemplary signal calculation module consistent with the disclosed embodiments of the present disclosure.

FIG. 15 illustrates a specific structural diagram of another exemplary signal calculation module consistent with the disclosed embodiments of the present disclosure. The structure of the comparison circuit 122 is consistent with above descriptions. In one embodiment, the common potential is taken as zero (0). As shown in FIG. 15, the first operational amplifier is labelled with M1, and the second operational amplifier is labelled with M2. The working voltage terminal of the first operational amplifier M1 and the working voltage terminal of the second operational amplifier M2 are omitted in FIG. 15. Different from FIG. 14, the first peripheral sub-circuit 1211 in FIG. 15 further includes a second capacitor C2 and an eleventh resistor R11.

The second capacitor C2 is located between the seventh power terminal V7 and the seventh resistor R7. The eleventh resistor R11 is located between an eighth power terminal V8 and the first output terminal, and the eleventh resistor R11 is also connected to the tenth resistor R10. The seventh power terminal V7 and the eighth power terminal V8 may be set according to working scenarios and working requirements, and are not limited in the present disclosure. For example, the seventh power terminal V7 and the eighth power terminal V8 may be ground.

In one embodiment, as shown in FIG. 15, a portion of the first peripheral sub-circuit 1211 is same as the first peripheral sub-circuit 1211 shown in FIG. 14. Performance of components of the portion of the first peripheral sub-circuit 1211 may drift to a certain extent with time of use. In one embodiment, the second capacitor C2 added may stabilize the voltage of the first non-inverting input terminal, and the eleventh resistor R11 added may stabilize the voltage of the first output terminal. Accordingly, the first data signal output by the first output terminal may be more stable, and the pulse width modulation signal generated according to the first data signal may thus be more accurate. As such, the light-emitting component 11 may be controlled more accurately, and the display effect of the display device may thus be improved.

In one embodiment, in the third power terminal V3, the fourth power terminal V4, the fifth power terminal V5, the sixth power terminal V6, the seventh power terminal V7, and the eighth power terminal V8, voltages of different power supply terminals may be same or different. The present disclosure does not limit whether the voltages of different power supply terminals are same or different.

Figure 16:
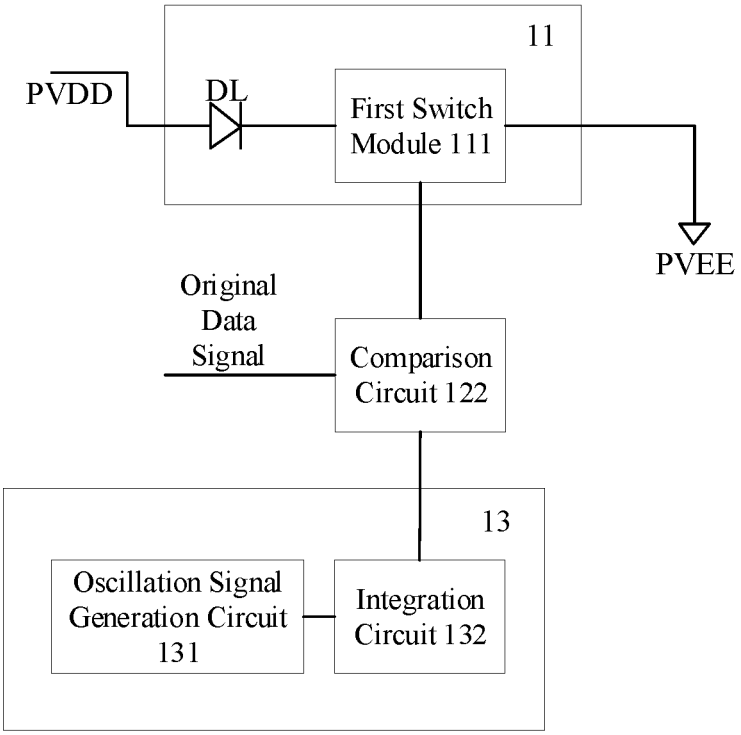
FIG. 16 illustrates a structural diagram of another partial circuit of an exemplary light-emitting panel consistent with the disclosed embodiments of the present disclosure.

FIG. 16 illustrates a structural diagram of another partial circuit of an exemplary light-emitting panel consistent with the disclosed embodiments of the present disclosure. In one embodiment, as shown in FIG. 16, the reference-signal generation module 13 includes an oscillation signal generation circuit 131 and an integration circuit 132. The integration circuit 132 is connected to the oscillation signal generation circuit 131.

The oscillation signal generation circuit 131 may be used to generate an oscillation signal. In some embodiments, the oscillation signal may specifically include a square wave signal or a square wave-like signal, and is not limited by the present disclosure. A square wave-like signal is a signal similar to a square wave signal.

The integration circuit 132 may be used to perform an integration operation on an oscillation signal generated by the oscillation signal generation circuit 131 to obtain a reference signal. That is, the integration circuit 132 may perform waveform transformation on the oscillation signal to obtain the reference signal. For specific contents of the reference signal, reference may be made to relevant descriptions above.

Specific structures of the oscillation signal generation circuit 131 and the integration circuit 132 in the reference-signal generation module 13 are described below.

Figure 17:
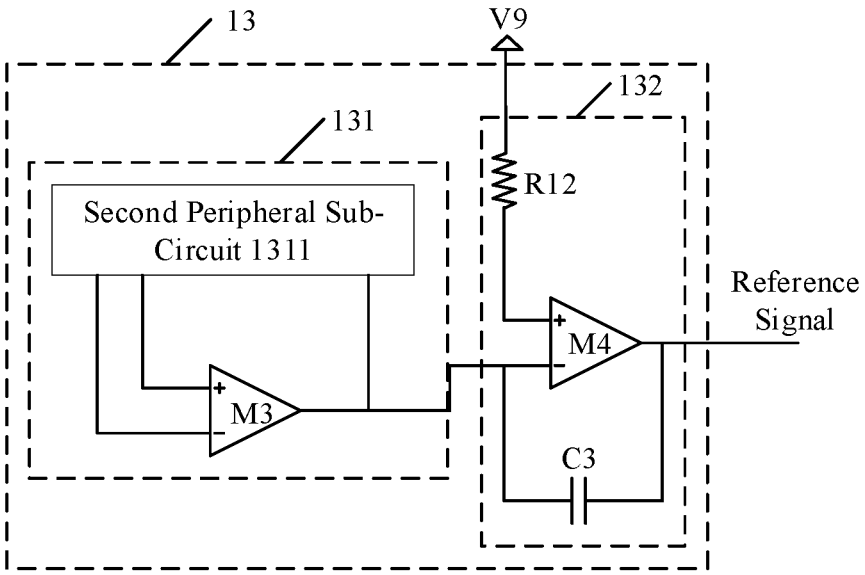
FIG. 17 illustrates a structural diagram of an exemplary reference-signal generation module consistent with the disclosed embodiments of the present disclosure.

FIG. 17 illustrates a specific structural diagram of an exemplary reference-signal generation module consistent with the disclosed embodiments of the present disclosure. In one embodiment, as shown in FIG. 17, the oscillation signal generation circuit 131 may include a third operational amplifier M3 and a second peripheral sub-circuit 1311. The third non-inverting input terminal of the third operational amplifier M3, the third inverting input terminal of the third operational amplifier M3, and the third output terminal of the third operational amplifier M3 are connected to the second peripheral sub-circuit 1311. The third non-inverting input terminal is the non-inverting input terminal of the third operational amplifier M3. The third inverting input terminal is the inverting input terminal of the third operational amplifier M3. The third output terminal is the output terminal of the third operational amplifier M3.

In one embodiment, the integration circuit 132 may include a fourth operational amplifier M4, a twelfth resistor R12, and a third capacitor C3. The twelfth resistor R12 is located between a ninth power terminal V9 and the fourth non-inverting input terminal of the fourth operational amplifier M4. The third capacitor C3 is located between the fourth inverting input terminal of the fourth operational amplifier M4 and the fourth output terminal of the fourth operational amplifier M4. The ninth power supply terminal V9 may be set according to working scenarios and working requirements, and is not limited in the present disclosure. For example, the ninth power terminal V9 may be ground.

The fourth inverting input terminal is connected to the oscillation signal generation circuit 131. The fourth output terminal may output a reference signal. The fourth non-inverting input terminal is the non-inverting input terminal of the fourth operational amplifier M4. The fourth inverting input terminal is the inverting input terminal of the fourth operational amplifier M4. The fourth output terminal is the output terminal of the fourth operational amplifier M4.

The third operational amplifier M3 and the second peripheral sub-circuit 1311 may work together to realize functions of the oscillation signal generation circuit 131. Specific structures of the reference-signal generation module 13 are described below with exemplary second peripheral sub-circuits 1311.

Figure 18:
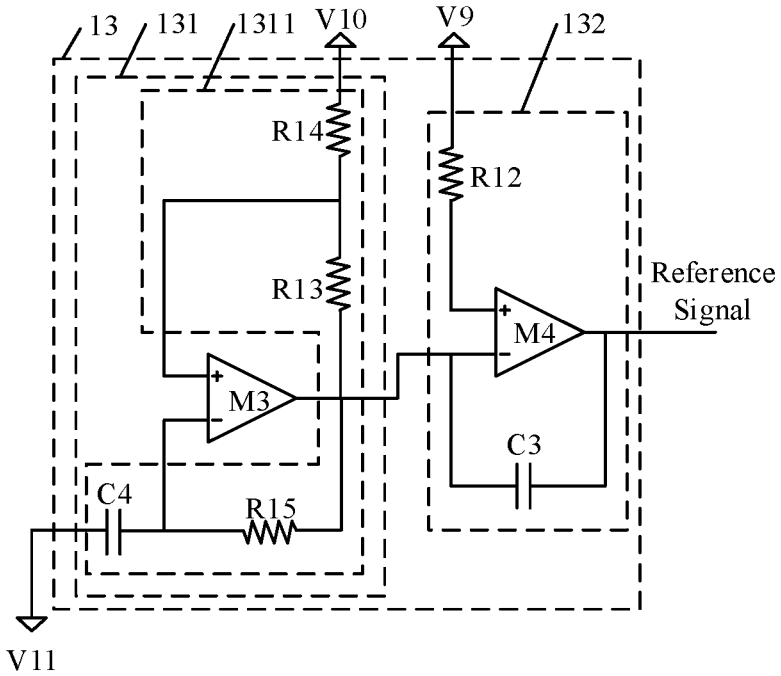
FIG. 18 illustrates a specific structure diagram of an exemplary reference-signal generation module consistent with the disclosed embodiments of the present disclosure.

FIG. 18 illustrates a specific structure diagram of an exemplary reference-signal generation module consistent with the disclosed embodiments of the present disclosure. The structure of the integrating circuit is consistent with above descriptions. As shown in FIG. 18, the third operational amplifier is labelled with M3, the fourth operational amplifier is labelled with M4, the twelfth resistor is labelled with R12, and the third capacitor is labelled with C3. A working voltage terminal of the third operational amplifier M3 and a working voltage terminal of the fourth operational amplifier M4 are omitted in FIG. 18. The second peripheral sub-circuit 1311 includes a thirteenth resistor R13, a fourteenth resistor R14, a fifteenth resistor R15, and a fourth capacitor C4.

The thirteenth resistor R13 is located between the third non-inverting input terminal and the third output terminal. The fourteenth resistor R14 is located between the thirteenth resistor R13 and a tenth power terminal V10. The fifteenth resistor R15 is located between the third inverting input terminal and the third output terminal. The fourth capacitor C4 is located between an eleventh power terminal V11 and the third inverting input terminal. The tenth power supply terminal V10 and the eleventh power supply terminal V11 may be set according to working scenarios and working requirements, and are not limited in the present disclosure. For example, the tenth power terminal V10 and the eleventh power terminal V11 may be ground.

The fifteenth resistor R15 and the fourth capacitor C4 may form a negative feedback network to feed back the signal from the third output terminal to the third inverting input terminal. The fifteenth resistor R15 and the fourth capacitor C4 may also play a delay role. The thirteenth resistor R13 may serve as a positive feedback network to feed back the signal from the third output terminal to the third non-inverting input terminal. According to the signals fed back from the third output terminal to the third non-inverting input terminal and the third inverting input terminal, the third operational amplifier M3 may generate an oscillating signal that alternately appears in two states. For example, when the oscillating signal is a square wave signal, the third output terminal may output a square wave signal with high and low levels alternately.

Figure 19:
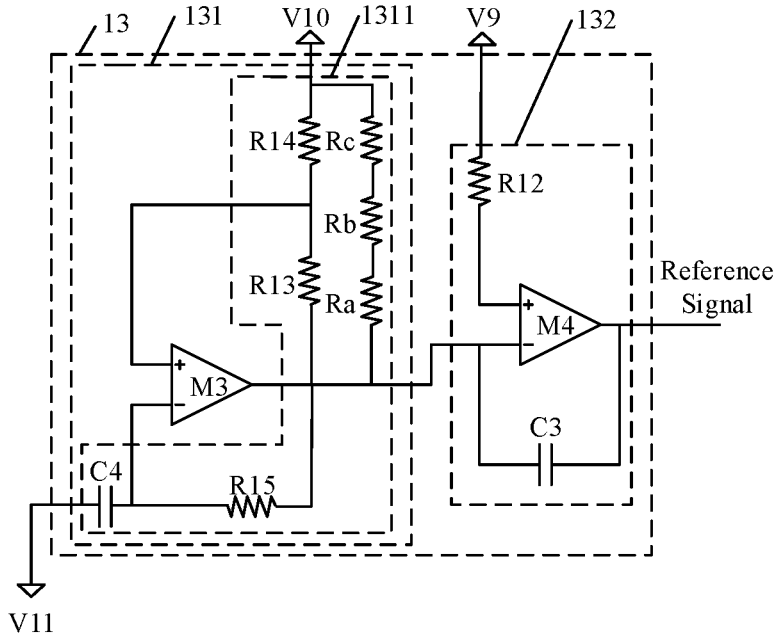
FIG. 19 illustrates a specific structure diagram of another exemplary reference-signal generation module consistent with the disclosed embodiments of the present disclosure.

FIG. 19 illustrates a specific structure diagram of another exemplary reference-signal generation module consistent with the disclosed embodiments of the present disclosure. The structure of the integrating circuit is consistent with above descriptions. The third operational amplifier is labelled with M3, the fourth operational amplifier is labelled with M4, the twelfth resistor is labelled with R12, and the third capacitor is labelled with C3. A working voltage terminal of the third operational amplifier M3 and a working voltage terminal of the fourth operational amplifier M4 are omitted in FIG. 19. Different from FIG. 18, the second peripheral sub-circuit 1311 in FIG. 19 further includes a resistor network. The resistor network is located between the third non-inverting input terminal and the third output terminal. The resistor network may include at least one resistor. The resistance value and the number of resistors in the resistor network may be set according to working scenarios and working requirements, and are not limited in the present disclosure. In one embodiment, as shown in FIG. 19, the resistance network includes a resistance Ra, a resistance Rb, and a resistance Rc.

As the use time increases, performance of components in the second peripheral sub-circuit 1311 shown in FIG. 18 may drift. Accordingly, the oscillation signal output by the oscillation signal generation circuit may be affected, and accuracy of the oscillation signal may be reduced. In one embodiment, as shown in FIG. 19, the resistor network added may be used to stabilize the input and output of the third operational amplifier M3, and the drift caused by the performance of other components may thus be compensated for. Accordingly, stability and accuracy of the oscillation signal generated by the oscillation signal generation circuit may be improved.

Figure 20:
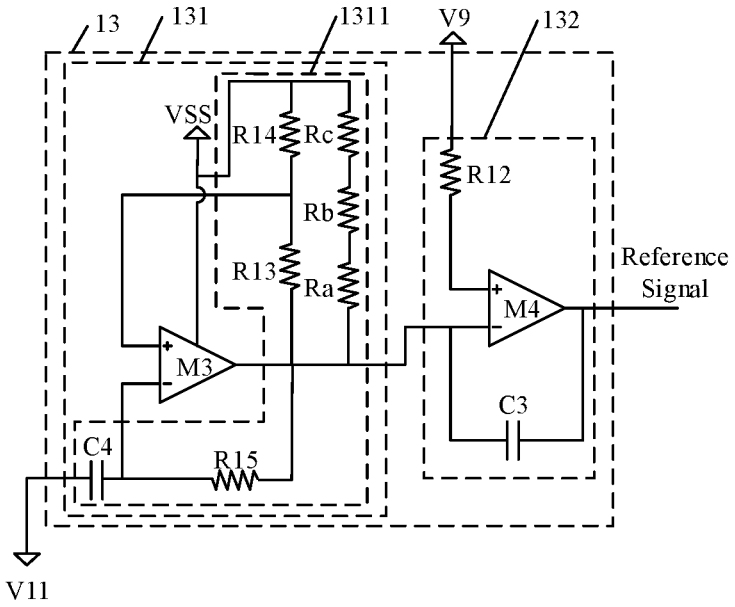
FIG. 20 illustrates a specific structure diagram of another exemplary reference-signal generation module consistent with the disclosed embodiments of the present disclosure.

FIG. 20 illustrates a specific structure diagram of another exemplary reference-signal generation module consistent with the disclosed embodiments of the present disclosure. The structure of the integration circuit is consistent with above descriptions. The third operational amplifier is labelled with M3, the fourth operational amplifier is labelled with M4, the twelfth resistor is labelled with R12, and the third capacitor is labelled with C3. A working voltage terminal of the third operational amplifier M3 and a working voltage terminal of the fourth operational amplifier M4 are omitted in FIG. 20. Different from FIG. 19, a working power low-voltage terminal VSS in FIG. 20 may provide a low-voltage working power for the third operational amplifier M3, and the working power low-voltage terminal VSS in FIG. 20 may be multiplexed as the tenth power terminal V10 in FIG. 19. That is, the fourteenth resistor R14 in FIG. 20 is located between the thirteenth resistor R13 and the working power low-voltage terminal VSS of the third operational amplifier M3. Accordingly, the number of power supply terminals to be connected to the oscillation signal generation circuit may be reduced, and the structure of the oscillation signal generation circuit may be simplified. As such, the structure of the reference-signal generation module 13 may be simplified, and the structure of the light-emitting panel may thus be simplified.

Figure 21:
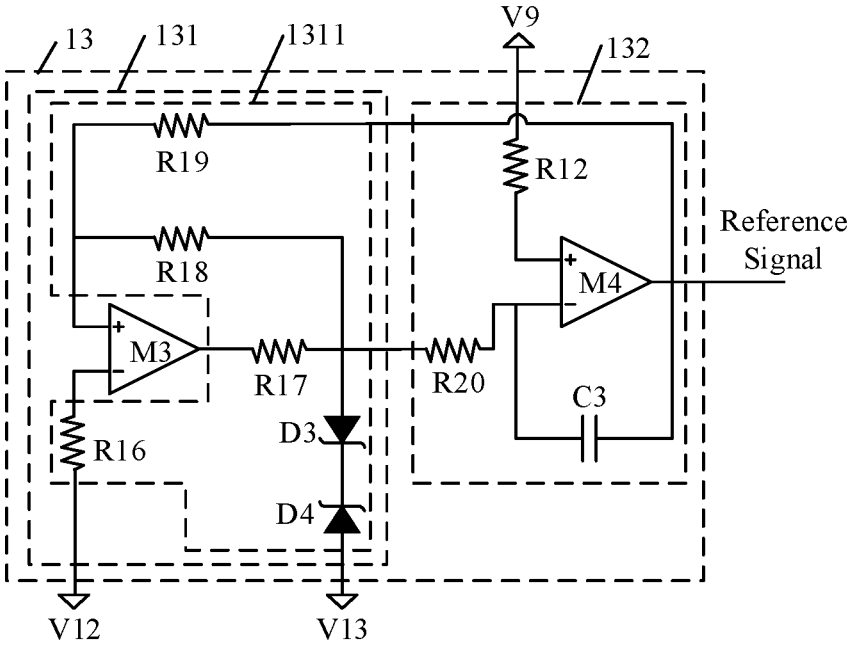
FIG. 21 illustrates a specific structure diagram of another exemplary reference-signal generation module consistent with the disclosed embodiments of the present disclosure.

FIG. 21 illustrates a specific structure diagram of another exemplary reference-signal generation module consistent with the disclosed embodiments of the present disclosure. The structure of the integration circuit is consistent with above descriptions. The third operational amplifier is labelled with M3, the fourth operational amplifier is labelled with M4, the twelfth resistor is labelled with R12, and the third capacitor is labelled with C3. The working voltage terminal of the third operational amplifier M3 and the working voltage terminal of the fourth operational amplifier M4 are omitted in FIG. 21. The second peripheral sub-circuit 1311 includes a sixteenth resistor R16, a seventeenth resistor R17, an eighteenth resistor R18, a nineteenth resistor R19, a first Zener diode D3, and a second Zener diode D4.

The sixteenth resistor R16 is located between the third inverting input terminal and the twelfth power supply terminal V12. The seventeenth resistor R17 is located between the third output terminal and the integration circuit. The eighteenth resistor R18 is located between the third non-inverting input terminal and the seventeenth resistor R17.

The nineteenth resistor R19 is located between the third non-inverting input terminal and the fourth output terminal. The first Zener diode D3 and the second Zener diode D4 connected in reverse series are located between the eighteenth resistor R18 and the thirteenth power terminal V13. The twelfth power supply terminal V12 and the thirteenth power supply terminal V13 may be set according to working scenarios and working requirements, and are not limited in the present disclosure. For example, the twelfth power supply terminal V12 and the thirteenth power supply terminal V13 may be ground.

The signal output from the third output terminal may be fed back to the third non-inverting input terminal through the seventeenth resistor R17 and the eighteenth resistor R18. The signal output from the fourth output terminal may be fed back to the third non-inverting input terminal through the nineteenth resistor R19. The third operational amplifier M3 may output an oscillating signal according to the signal fed back to the third non-inverting input terminal. The first Zener diode D3 and the second Zener diode D4 connected in anti-series may play a role of bidirectional amplitude limiting. That is, a voltage amplitude of the oscillation signal output by the oscillation signal generation circuit may be limited between −Uz and Uz. Uz is a stable voltage of the first Zener diode D3 and the second Zener diode D4. Accordingly, the first Zener diode D3 and the second Zener diode D4 may prevent the voltage amplitude of the oscillation signal output by the oscillation signal generation circuit from shifting, and stability and accuracy of the oscillation signal may thus be ensured.

In one embodiment, as shown in FIG. 21, the integration circuit may further include a twentieth resistor R20. The twentieth resistor R20 is located between the oscillating signal generation circuit and the fourth inverting input terminal, and may function as a voltage divider.

For the reference signal to interact with the first data signal to generate a pulse width modulation signal, the reference signal may be amplified. The amplified reference signal and the first data signal may be used to generate the pulse width modulation signal. Correspondingly, the reference-signal generation module 13 may further include an amplification circuit. The amplification circuit may be connected to the integration circuit. The amplification circuit may be used to amplify the reference signal.

Figure 22:
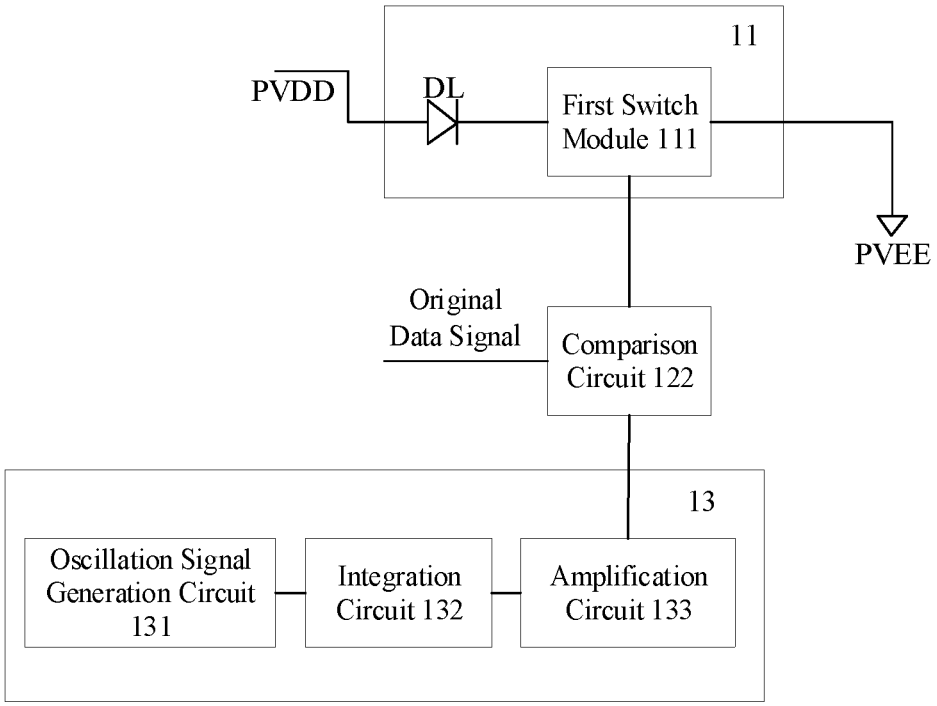
FIG. 22 illustrates a structural diagram of another partial circuit of an exemplary light-emitting panel consistent with the disclosed embodiments of the present disclosure.

In some embodiments, the reference signal module may further include an amplification circuit. FIG. 22 illustrates a structural diagram of another partial circuit of an exemplary light-emitting panel consistent with the disclosed embodiments of the present disclosure. Different from FIG. 16, the reference-signal generation module 13 shown in FIG. 22 further includes an amplification circuit 133. The amplification circuit 133 is connected to the integration circuit 132 for amplifying the reference signal output by the integration circuit. A specific structure of the amplifying circuit 133 in the reference-signal generation module 13 is described below.

Figure 23:
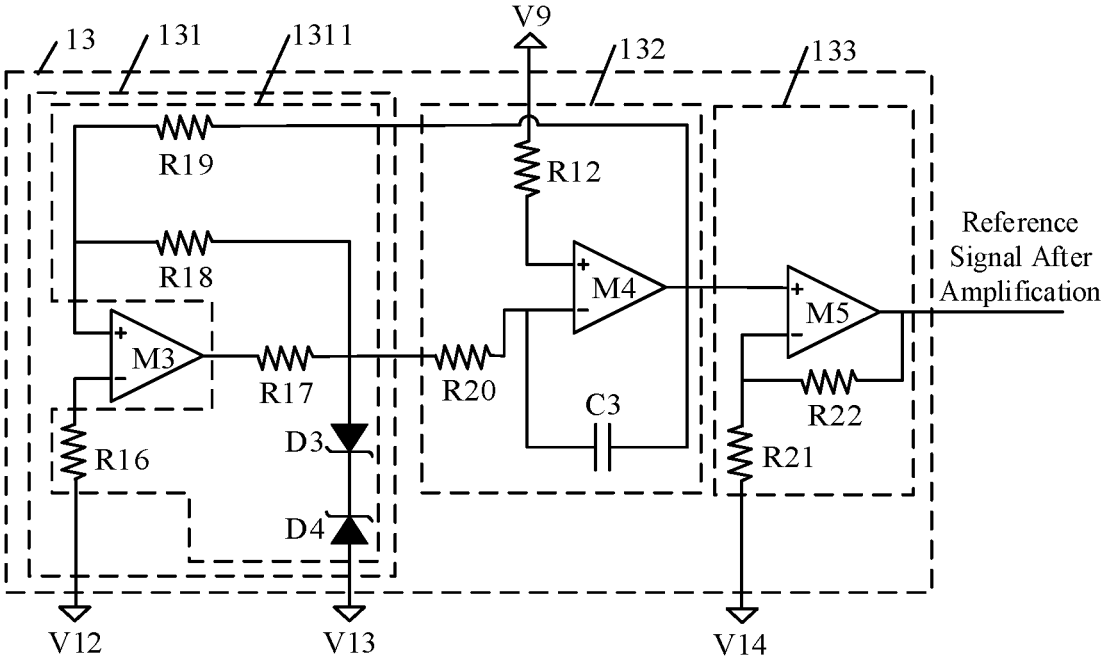
FIG. 23 illustrates a specific structure diagram of another exemplary reference-signal generation module consistent with the disclosed embodiments of the present disclosure.

FIG. 23 illustrates a specific structure diagram of another exemplary reference-signal generation module consistent with the disclosed embodiments of the present disclosure. Different from FIG. 21, the reference-signal generation module 13 shown in FIG. 23 further includes an amplification circuit 133. The amplification circuit 133 may include a fifth operational amplifier M5, a twenty-first resistor R21 and a twenty-second resistor R22.

The twenty-first resistor R21 is located between the fifth inverting input terminal of the fifth operational amplifier M5 and the fourteenth power terminal V14. The twenty-second resistor R22 is located between the fifth inverting input terminal and the fifth output terminal of the fifth operational amplifier M5. The fifth non-inverting input terminal of the fifth operational amplifier M5 is connected to the integration circuit. The fifth output terminal is connected to the signal calculation module 12. Specifically, in one embodiment, the fifth output terminal may be connected to the non-inverting input terminal of the second operational amplifier M2. The fifth output terminal may output the reference signal after amplification. The fifth non-inverting input terminal is the non-inverting input terminal of the fifth operational amplifier M5. The fifth inverting input terminal is the inverting input terminal of the fifth operational amplifier M5. The fifth output terminal is the output terminal of the fifth operational amplifier M5. The fourteenth power terminal V14 may be set according to working scenarios and working requirements, and is not limited in the present disclosure. For example, the fourteenth power terminal V14 may be ground.

In the present disclosure, a resistance value of each resistor may be set according to working scenarios and working requirements, and is not limited in the present disclosure. In the present disclosure, one resistor may also be replaced by a plurality of resistors.

In the present disclosure, the light-emitting panel may be a backlight module or a display panel. The present disclosure does not limit whether the light-emitting panel is a backlight module or a display panel.

Figure 24:
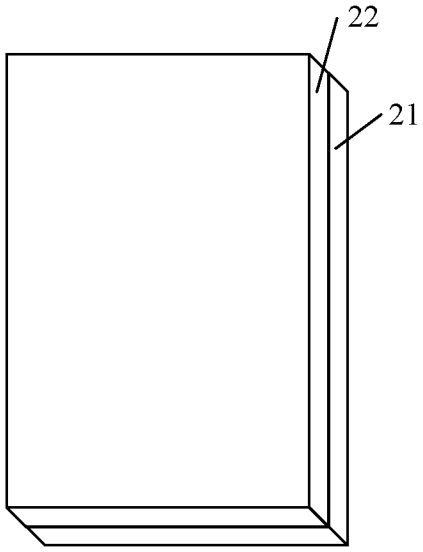
FIG. 24 illustrates a structural diagram of a display device consistent with the disclosed embodiments of the present disclosure.

The present disclosure also provides a display device. The display device may include a light-emitting panel provided by the present disclosure. FIG. 24 illustrates a structural diagram of an exemplary display device consistent with the disclosed embodiments of the present disclosure. In one embodiment, the light-emitting panel is specifically a backlight module. As shown in FIG. 24, the display device may include a backlight module 21 and a display panel 22. Other structures may be included between the backlight module 21 and the display panel 22, and are not limited in the present disclosure. The display device may specifically be a device with a display function, such as a mobile phone, a computer, a tablet computer, a TV, electronic paper, and the like, and is not limited in the present disclosure.

As disclosed, the technical solutions of the present disclosure have the following advantages.

The present disclosure provides a light-emitting panel and a display device. After a signal calculation module generates a first data signal according to an original data signal and a common potential, the signal calculation module may generate a pulse width modulation signal according to the first data signal and a reference signal generated by a reference-signal generation module. The original data signal may be an analog signal used to characterize image information of a display area corresponding to a light-emitting component. That is, the analog signal representing the image information, that is, the original data signal, may be processed and converted to obtain the pulse width modulation signal for controlling light emission of the light-emitting component. The pulse width modulation signal may include a high level and a low level. A light-emission duration of the light-emitting component may be controlled by a duty ratio of the pulse width modulation signal. That is, using the pulse width modulation signal, the light-emission duration of the light-emitting component may be controlled. A gray scale of the light-emitting component may be controlled by the light-emission duration, rather than a voltage. Accordingly, precise control of the gray scale may be realized.

The embodiments disclosed herein are exemplary only and not limiting the scope of this disclosure. Various combinations, alternations, modifications, equivalents, or improvements to the technical solutions of the disclosed embodiments can be obvious to those skilled in the art. Without departing from the spirit and scope of this disclosure, such combinations, alternations, modifications, equivalents, or improvements to the disclosed embodiments are intended to be encompassed within the scope of the present disclosure.

What is claimed is:

1. A light-emitting panel, comprising:

a plurality of light-emitting components arranged in an array;

a plurality of signal calculation modules;

a reference-signal generation module;

a first power terminal; and a second power terminal, wherein:

a light-emitting component of the plurality of light-emitting components includes a light-emitting module and a first switch module, wherein the light-emitting module and the first switch module are connected in series between the first power terminal and the second power terminal;

a control terminal of the first switch module is connected to a signal calculation module of the plurality of signal calculation modules, and the signal calculation module is connected to the reference-signal generation module;

the reference-signal generation module is configured to generate a reference signal;

the signal calculation module is configured to receive an original data signal and the reference signal, and generate a first data signal according to the original data signal and a common potential;

the signal calculation module is further configured to generate a pulse width modulation signal according to the first data signal and the reference signal, and to control the light-emitting module to emit light by controlling the first switch module using the pulse width modulation signal;

the original data signal is an analog signal for characterizing image information of a display area corresponding to the light-emitting component; and the common potential is preset according to a voltage range of the original data signal.

2. The light-emitting panel according to claim 1, wherein:

the plurality of light-emitting components and the plurality of signal calculation modules are arranged in one-to-one correspondence; or each column of the plurality of light-emitting components is correspondingly configured with a signal calculation module of the plurality of signal calculation modules, and each light-emitting element in each column of the plurality of light-emitting elements is connected to a different first power supply terminal of the first power supply terminals.

3. The light-emitting panel according to claim 1, wherein:

the plurality of light-emitting components arranged in the array is correspondingly configured with one reference-signal generation module; and the reference signal includes a triangular wave or a sawtooth wave.

4. The light-emitting panel according to claim 1, wherein:

the light-emitting component further includes a second switch module;

the second switch module is located between the light-emitting module and the second power terminal; and a control terminal of the second switch module is connected to a scan signal terminal.

5. The light-emitting panel according to claim 1, wherein the signal calculation module includes a forward calculation circuit and a comparison circuit, wherein:

the forward calculation circuit is configured to adjust signal voltage lower than the common potential in the original data signal to the common potential, and to generate and output the first data signal;

the comparison circuit is configured to compare the first data signal with the reference signal, and to generate the pulse width modulation signal; and the comparison circuit is connected to the forward calculation circuit, the reference-signal generation module, and the first switch module.

6. The light-emitting panel according to claim 5, wherein:

the forward calculation circuit includes a first operational amplifier and a first peripheral sub-circuit, wherein a first non-inverting input terminal of the first operational amplifier, a first inverting input terminal of the first operational amplifier, and a first output terminal of the first operational amplifier are connected to the first peripheral sub-circuit, and the first peripheral sub-circuit is configured to receive the original data signal; and the comparison circuit includes a second operational amplifier, wherein a second non-inverting input terminal of the second operational amplifier is connected to the reference-signal generation module, a second inverting input terminal of the second operational amplifier is connected to the first output terminal of the first operational amplifier and the first peripheral sub-circuit, and a second output terminal of the second operational amplifier is connected to the control terminal of the first switch module.

7. The light-emitting panel according to claim 6, wherein:

the first peripheral sub-circuit includes a first resistor, a second resistor, a third resistor, a first diode, and a second diode, wherein:

the second resistor is configured to receive the original data signal;

the second resistor is connected in series with the first resistor, and the first resistor is connected to the first inverting input terminal;

the second resistor, the first diode, and the second diode are connected in series;

the third resistor is connected in parallel with the second resistor, the first diode and the second diode;

a cathode of the first diode and an anode of the second diode are connected to the first output terminal; and the first non-inverting input terminal is connected to a third power terminal, or the first peripheral sub-circuit includes a fourth resistor, a fifth resistor, a sixth resistor, a first capacitor, and a first switch transistor, wherein:

a control terminal of the first switch transistor and the fourth resistor are configured to receive the original data signal;

the first switch transistor is connected in parallel with the fourth resistor;

one terminal of the first capacitor is connected to the first switch transistor and the fourth resistor that are connected in parallel, and the other terminal of the first capacitor is connected to a fourth power terminal;

the first switch transistor and the fourth resistor connected in parallel are connected to the first non-inverting input terminal;

the fifth resistor is located between the first inverting input terminal and the first output terminal; and the sixth resistor is located between the first inverting input terminal and a fifth power terminal, or the first peripheral sub-circuit includes a seventh resistor, an eighth resistor, a ninth resistor, and a tenth resistor, wherein:

the seventh resistor is configured to receive the original data signal;

the eighth resistor is configured to receive an adjustment signal, wherein the adjustment signal is configured to raise a signal voltage lower than the common potential in the original data signal to the common potential; and the seventh resistor and the eighth resistor are connected to the first non-inverting input terminal;

the ninth resistor is located between a sixth power terminal and the first inverting input terminal; and the tenth resistor is located between the first inverting input terminal and the first output terminal.

8. The light-emitting panel according to claim 7, wherein the first peripheral sub-circuit further includes a second capacitor and an eleventh resistor, wherein:

the second capacitor is located between a seventh power terminal and the seventh resistor; and the eleventh resistor is located between an eighth power terminal and the first output terminal, and the eleventh resistor is also connected to the tenth resistor.

9. The light-emitting panel according to claim 1, wherein:

the reference-signal generation module includes an oscillation signal generation circuit and an integration circuit, wherein:

the oscillation signal generation circuit is configured to generate an oscillation signal, and the integration circuit is connected to the oscillation signal generation circuit; and the integration circuit is configured to perform an integration operation on the oscillation signal generated by the oscillation signal generation circuit to obtain the reference signal, and the reference-signal generation module further includes an amplification circuit, wherein the amplification circuit is connected to the integration circuit, and is configured for amplifying the reference signal output by the integration circuit.

10. The light-emitting panel according to claim 9, wherein:

the oscillation signal includes a square wave signal or a square wave-like signal.

11. The light-emitting panel according to claim 9, wherein:

the oscillation signal generation circuit includes a third operational amplifier and a second peripheral sub-circuit, wherein a third non-inverting input terminal of the third operational amplifier, the third inverting input terminal of the third operational amplifier, and a third output terminal of the third operational amplifier are connected to the second peripheral sub-circuit; and the integration circuit include a fourth operational amplifier, a twelfth resistor, and a third capacitor, wherein the twelfth resistor is located between a ninth power terminal and a fourth non-inverting input terminal of the fourth operational amplifier, the third capacitor is located between a fourth inverting input terminal of the fourth operational amplifier and a fourth output terminal of the fourth operational amplifier; and the fourth inverting input terminal is connected to the oscillation signal generation circuit, and the fourth output terminal output the reference signal.

12. The light-emitting panel according to claim 11, wherein:

the second peripheral sub-circuit includes a thirteenth resistor, a fourteenth resistor, a fifteenth resistor, and a fourth capacitor, wherein:

the thirteenth resistor is located between the third non-inverting input terminal and the third output terminal;

the fourteenth resistor is located between the thirteenth resistor and a tenth power terminal;

the fifteenth resistor is located between the third inverting input terminal and the third output terminal; and the fourth capacitor is located between an eleventh power terminal and the third inverting input terminal, or the second peripheral sub-circuit includes a sixteenth resistor, a seventeenth resistor, an eighteenth resistor, a nineteenth resistor, a first Zener diode, and a second Zener diode, wherein:

the sixteenth resistor is located between the third inverting input terminal and a twelfth power supply terminal;

the seventeenth resistor is located between the third output terminal and the integration circuit;

the eighteenth resistor is located between the third non-inverting input terminal and the seventeenth resistor;

the nineteenth resistor is located between the third non-inverting input terminal and the fourth output terminal; and the first Zener diode and the second Zener diode connected in reverse series are located between the eighteenth resistor and a thirteenth power terminal.

13. The light-emitting panel according to claim 12, wherein the second peripheral sub-circuit further includes a resistor network, wherein:

the resistor network is located between the third non-inverting input terminal and the third output terminal.

14. The light-emitting panel according to claim 13, wherein:

a working power low-voltage terminal, providing a low-voltage working power for the third operational amplifier, is multiplexed as the tenth power terminal.

15. The light-emitting panel according to claim 11, wherein the integration circuit further include a twentieth resistor, wherein:

the twentieth resistor is located between the oscillating signal generation circuit and the fourth inverting input terminal.

16. The light-emitting panel according to claim 9, wherein the amplification circuit includes a fifth operational amplifier, a twenty-first resistor and a twenty-second resistor, wherein:

the twenty-first resistor is located between a fifth inverting input terminal of the fifth operational amplifier and a fourteenth power terminal;

the twenty-second resistor is located between the fifth inverting input terminal and a fifth output terminal of the fifth operational amplifier; and a fifth non-inverting input terminal of the fifth operational amplifier is connected to the integration circuit, and the fifth output terminal is connected to the signal calculation module.

17. The light-emitting panel according to claim 1, wherein:

the first switch module includes a switch transistor, wherein:

the control terminal of the first switch module includes a control terminal of the switch transistor; and a first terminal or a second terminal of the switch transistor is connected to the light-emitting module, and the light-emitting module includes at least one light-emitting diode, wherein the at least one light-emitting diode includes a micro light-emitting diode.

18. The light-emitting panel according to claim 4, wherein the second switch module includes a switch transistor, wherein:

the control terminal of the second switch module includes a control terminal of the switch transistor; and a first terminal or a second terminal of the second switch module is connected to the light-emitting module.

19. The light-emitting panel according to claim 1, wherein:

the light-emitting panel is a backlight module or a display panel.

20. A display device, comprising:

a display panel, including:

a plurality of light-emitting components arranged in an array;

a plurality of signal calculation modules;

a reference-signal generation module;

a first power terminal; and a second power terminal, wherein:

a light-emitting component of the plurality of light-emitting components includes a light-emitting module and a first switch module, wherein the light-emitting module and the first switch module are connected in series between the first power terminal and the second power terminal;

a control terminal of the first switch module is connected to a signal calculation module of the plurality of signal calculation modules, and the signal calculation module is connected to the reference-signal generation module;

the reference-signal generation module is configured to generate a reference signal;

the signal calculation module is configured to receive an original data signal and the reference signal, and generate a first data signal according to the original data signal and a common potential;

the signal calculation module is further configured to generate a pulse width modulation signal according to the first data signal and the reference signal, and to control the light-emitting module to emit light by controlling the first switch module using the pulse width modulation signal;

the original data signal is an analog signal for characterizing image information of a display area corresponding to the light-emitting component; and the common potential is preset according to a voltage range of the original data signal.

* * * * *